US005222628A

United States Patent [19]

Roethel

[11] Patent Number: 5,222,628

[45] Date of Patent: Jun. 29, 1993

[54] ANCHORING ASSEMBLY FOR CUP DISPENSING DIAPHRAGM

[75] Inventor: Henry G. Roethel, Ravenna, Ohio

[73] Assignee: The Meyer Company, Cleveland, Ohio

[21] Appl. No.: 871,849

[22] Filed: Apr. 21, 1992

[51] Int. Cl.[5] ..... A47F 1/04

[52] U.S. Cl. ..... 221/307; 221/310

[58] Field of Search ..... 221/303, 307, 309, 310, 221/63

[56] References Cited

U.S. PATENT DOCUMENTS

| | | | |
|---|---|---|---|
| 1,131,255 | 3/1915 | Luellen | 221/310 |
| 2,543,746 | 3/1951 | Morrison | 221/307 |
| 3,006,503 | 10/1961 | O'Neil | 221/307 |

FOREIGN PATENT DOCUMENTS

| | | | |
|---|---|---|---|
| 8900684 | 10/1990 | Netherlands | 221/310 |
| 337583 | 11/1930 | United Kingdom | 221/310 |

*Primary Examiner*—David H. Bollinger

*Attorney, Agent, or Firm*—Fay, Sharpe, Beall, Fagan, Minnich & McKee

[57] ABSTRACT

An apparatus for storing a supply of cups or containers comprises a housing for maintaining the containers in a stacked, telescopically interfitted relationship. An open lower end of the housing has a resilient diaphragm extending there across with a lower face of the diaphragm having a hole therein to allow the lowermost container to be withdrawn while retaining the stack in the housing. The diaphragm has a peripheral flange which extends axially of the housing about the open lower end. A circumferentially continuous clamp sleeve is interference fitted over the peripheral flange of the diaphragm to clamp the flange in position. The clamp ring further includes a radially inward directed collar flange joined to the sleeve at the lower end thereof and extending in close engagement with the lower face thereof to locate the clamp ring on the housing and prevent the diaphragm from being deflected away from the bottom edge of the tubular side wall. The assembly also includes a protective sleeve depending from the collar flange to protect the diaphragm and lower cup.

8 Claims, 1 Drawing Sheet

FIG. 1
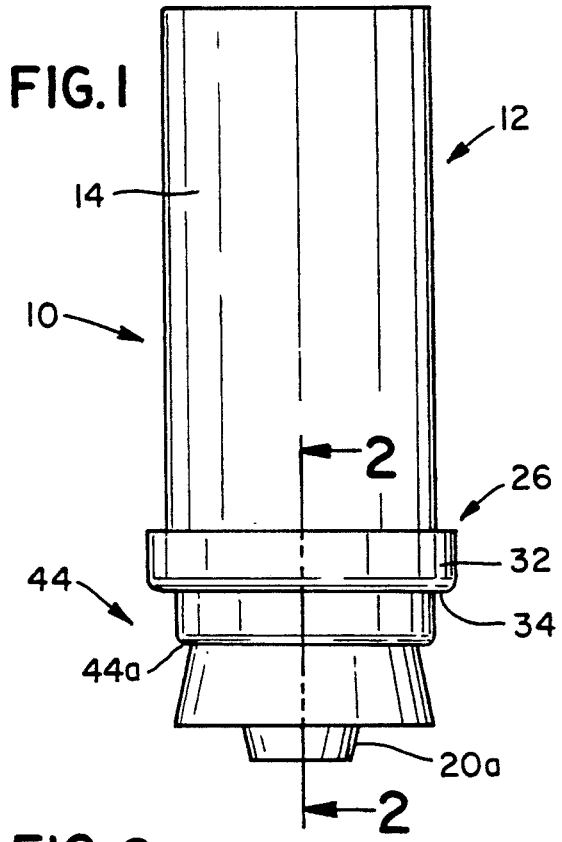
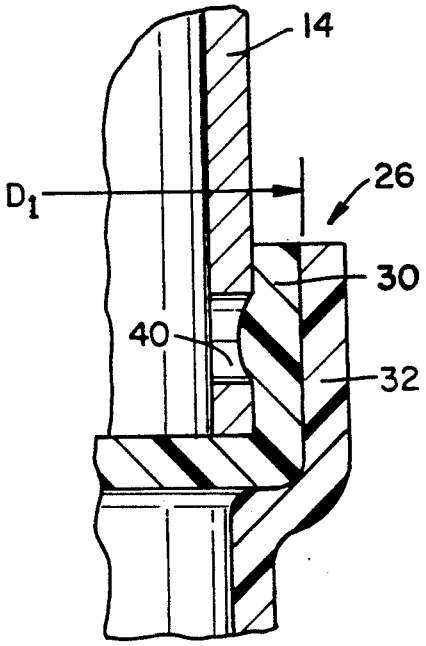
FIG. 3
FIG. 2
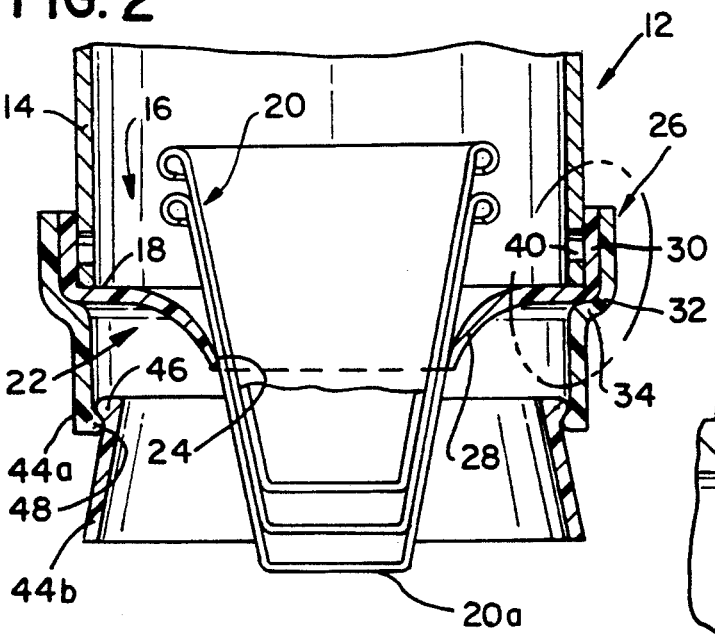
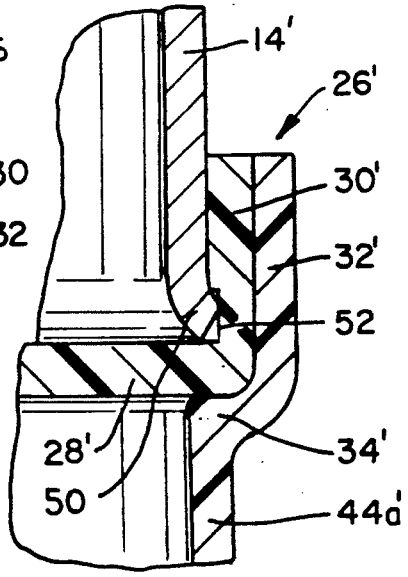
FIG. 4

ANCHORING ASSEMBLY FOR CUP DISPENSING DIAPHRAGM

BACKGROUND OF THE INVENTION

The subject invention is directed toward the art of cup dispensers and, more particularly, to an improved assembly for removably anchoring a dispensing diaphragm to the lower end of a cylindrical cup storage housing.

In the commonly assigned, copending U.S. application Ser. No. 07/833,985, filed Feb. 11, 1992, for "Dispenser for Cups and Cup-Like Articles", there is disclosed a cup storage and dispensing apparatus which includes a cylindrical storage chamber or housing having an open lower end across which is fitted a resilient diaphragm. The diaphragm has a central opening through which extends the lowermost cup of an interfitted stack of cups. The diaphragm retains the stack of cups in the housing while allowing the lowermost cup to be withdrawn through the diaphragm opening.

A problem with this general type of cup storage and dispensing apparatus has been the difficulty of retaining the diaphragm to the housing while permitting ready disconnection for cleaning and replacement.

Additionally, with cup dispensing devices of this type, it is desirable that the diaphragm be maintained in a protected position to avoid contamination from the users, hands. Likewise, it is often desirable that the exposed lower portion of the cup extending through the diaphragm be protected from airborne contamination, such as from sneezes and the like.

BRIEF STATEMENT OF THE INVENTION

The subject invention satisfies the above-mentioned problems and needs and provides an improved clamping or retaining assembly for releasably maintaining the diaphragm in position across the lower end of the cup storage housing.

In accordance with one aspect of the invention, a cup storage and supply apparatus of the type described includes a housing having an elongated tubular side wall for maintaining a supply of the containers in a stacked, telescopically interfitted relationship. The housing has an open lower end defined by a bottom edge of the tubular side wall with a resilient diaphragm extending across the open lower end with a lower face of the diaphragm having a hole therein to allow the lowermost container to be withdrawn while retaining the stack in the housing. The diaphragm has a circumferentially continuous, peripheral flange which extends axially of the housing about the open lower end upwardly in close engagement with the exterior of the tubular side wall. A clamp ring including a circumferentially continuous clamp sleeve portion is interference fitted over the peripheral flange of the diaphragm to clamp the flange to the side wall. The clamp ring further includes a radially inward directed collar flange joined to the sleeve portion at the lower end thereof and extending continuously about the diaphragm in close engagement with the lower face thereof to locate the clamp ring on the housing and to prevent the diaphragm from being deflected away from the bottom edge of the tubular side wall.

The interference fit between the continuous sleeve portion of the clamp ring and the peripheral flange on the diaphragm creates substantial frictional clamping engagement between the diaphragm and the exterior surface of the lower end of the side wall of the housing. The inwardly directed collar flange of the sleeve portion engages under the lower face of the diaphragm and prevents the forces applied to the diaphragm during cup removal from being directed in a manner to cause improper force application to the flange of the diaphragm to produce diaphragm removal. That is, the deflection of the face of the diaphragm when a cup is removed cannot be translated into axially directed forces of a type which would facilitate inadvertent removal of the diaphragm.

In accordance with a more limited aspect of the invention, it is contemplated that increased clamping force between the diaphragm and the housing can be achieved by providing a plurality of peripheral openings through the lower end of the side wall of the housing. These openings are located such that when the peripheral flange of the diaphragm is interference fitted and clamped in position, it overlies the openings and is partially extruded therethrough. This further increases the clamping force generated by the clamp ring.

In accordance with a further aspect of the invention, the clamp ring further includes a downwardly extending protective sleeve portion joined to the clamp flange for limiting user contact with the lower face of the diaphragm. Preferably, the protective sleeve is generally cylindrical and closely surrounds and extends below the lower face of the diaphragm sufficiently to prevent the user's hands from engaging the diaphragm when a cup is removed. It is also contemplated that the protective sleeve can extend sufficiently down so as to enclose substantially the entire length of the lowermost cup which extends through the diaphragm to thereby prevent the cup from being contacted by airborne contaminants, such as when a user in the area of the cup storage and supply device should sneeze.

In accordance with a further aspect of the invention, the protective sleeve can be made such that one piece is integral with the clamp ring and a second extension piece is separable therefrom so as to allow the actual length and coverage of the protective sleeve to be varied as desired.

As can be seen from the foregoing, a primary object of the invention is to provide a highly simplified and efficient clamping assembly for releasably joining a cup dispensing diaphragm to a storage housing.

A further object of the invention is the provision of an assembly of the type described wherein the clamp ring and the diaphragm held thereby can be readily removed and changed manually without the use of special tools or clamp release mechanisms.

A still further object is the provision of an apparatus of the type described wherein the components of the clamp ring assembly can be simple plastic moldings.

A still further object is the provision of an apparatus of the type described which incorporates sleeves to protect the diaphragm from inadvertent contact or contamination by the persons removing cups from the assembly.

BRIEF DESCRIPTION OF THE DRAWINGS

The above and other objects and advantages will become apparent from the following description when read in conjunction with the accompanying drawings wherein:

FIG. 1 is a side elevational view of a cup storage and dispensing apparatus formed in accordance with a preferred embodiment of the subject invention;

FIG. 2 is a cross-sectional view taken on lines 2—2 of FIG. 1;

FIG. 3 is a greatly enlarged view of the circled area of FIG. 2; and,

FIG. 4 is a view similar to FIG. 3, but showing a slightly modified assembly.

DETAILED DESCRIPTION OF THE PREFERRED EMBODIMENT

Referring more particularly to the drawings wherein the showings are for the purpose of illustrating a preferred embodiment of the invention only and not for the purpose of limiting same, FIGS. 1-3 show a cup storage and dispensing assembly 10 formed in accordance with the invention and comprising a housing 12 which is in the form of an elongated rigid, tubular member having a continuous side wall 14 of cylindrical configuration and terminating in a generally open, lower end 16 which is defined by the continuous lower edge 18 of the tubular side wall.

The tubular housing 12 is preferably formed from stainless steel, but it obviously could be formed from any suitable, relatively rigid material having sufficient structural strength and capable of being washed and cleaned as required for this type of use. It is important to note that the housing 12 is of a size so as to freely receive a stack of interfitted cups 20. The cups 20 can be of many different styles and sizes, but are typically of conical or truncated conical shape formed, for example, from paper or plastic and arranged such that suitable telescopically interfitted stacks of them can be received into the housing through the open upper end which can be closed by a removable cover, not shown.

Mounted to extend across the open lower end 16 of the housing 12 is a resilient, flexible and elastic dispensing diaphragm member 22. The diaphragm 22 is preferably formed from a highly resilient elastomeric material such as silicone, rubber, or the like. The actual design of the diaphragm member 22 could take many forms, but is preferably as shown and described in the commonly assigned, copending U.S. application Ser. No. 07,833,985, filed Feb. 11, 1992, for "Dispenser for Cups and Cup-Like Articles".

As shown, the diaphragm 22 has a central opening 24 through which the lowermost cup **20*a* of the stack 20 can extend. The central opening 24 is, of course, at least slightly smaller in diameter than the maximum diameter of the cup 20*a*. Thus, the diaphragm tightly grips about the surface of the lowermost cup to retain the cups in position in the housing 12** while the lowermost cup extends out the lower end as illustrated.

During use, the diaphragm 22 will, over time, become worn and must be replaced. Similarly, it is at times necessary to remove the diaphragm from the housing for cleaning of the diaphragm and the housing. According to the subject invention, removal and replacement of the diaphragm is greatly facilitated through the use of an improved clamping assembly 26. In the embodiment under consideration, the diaphragm 22 includes the lower, horizontally extending section 28 and a peripheral axially extending flange section 30 about which the clamp assembly 26 engages to clamp and hold the diaphragm in place on the lower end of the tubular side wall 14. The particular clamping assembly 26 illustrated in the drawings could be formed from many different materials but is desirably injection molded from a suitable, relatively rigid plastic. As shown, assembly 26 includes a circumferentially continuous and rigid clamp sleeve portion 32 which has an inner diameter $D_i$ which is slightly less than the outer diameter of the axially extending flange 30 when the diaphragm is in position on the tubular wall 14. Thus, to move the clamp ring sleeve portion into the fitted position shown in FIGS. 2 and 3, it is necessary to compress the resilient sleeve 30 and, in effect, an interference fit results. This creates substantial frictional engagement and generates compressive forces between the inner surface of the flange 30 and the outer surface of the tubular wall 14. The actual amount of interference designed into the clamp assembly 26 Will depend upon the materials from which the components are designed and their nominal dimensions, but typically an interference of 0.010" on the diameter is suitable.

The clamp ring assembly 26 further includes a radially inward directed collar flange 34 which is an integral extension and extends circumferentially about the entire clamp sleeve 32. The collar flange 34 extends inwardly a distance at least sufficient to underlie substantially the entire flange 30 and the wall 14. The location of the collar flange 34 thus acts to limit and position the mounting of clamp sleeve 32 and prevents the application of axially directed forces to the diaphragm flange 30. This results because the downward forces on the lower surface or face 28 of the diaphragm 22 cannot result in straightening the corner bend between the flange 30 and the bottom 28.

In order to increase the clamping and holding of the flange 30 relative to the tubular side wall 14, it is proposed that a circumferentially spaced series of openings 40 can be formed about the lower end of the wall 14. These openings 40 provide space into which a portion of the flange material 30 can extrude or deform when the clamp ring sleeve 32 is moved into position. This slight bulging shown in FIG. 3 further increases the forces required to cause an axial movement of the diaphragm flange 30 off the tubular side wall 14.

The clamp assembly 26 further preferably includes a protective sleeve portion 44 which extends downwardly from the collar flange 34. A first portion **44*a* of the protective sleeve is formed integrally with the collar flange 34 and extends downwardly in the manner shown in FIGS. 1 and 2. Note that it extends to a position well below the lower limit of the diaphragm 22. Thus, when reaching to remove a cup from the position shown in FIG. 2**, the user's hands will normally not make contact with the diaphragm, and the diaphragm is thus maintained in a more sanitary and protected condition.

The protective sleeve **44*a* can further include a second portion 44*b* which can be removed and used or not used as desired. This section 44*b* has a radially extending bead 46 about its upper end. A correspondingly shaped and located bead 48 is formed about the interior of the sleeve section 44*a*. The dimensional relationships are designed such that considering the nature of the material and its resiliency, the two parts 44*b* and 44*a* can be snapped together to produce axial engagement of their beads 46 and 48 to retain the lower sleeve section 44*b*** in position as desired.

As illustrated, section **44*b* of the protective sleeve preferably flares outwardly a slight amount and has a length such that it substantially completely covers the lower end of the lowermost cup 20*a***. This provides further protection to both the cup and the diaphragm from airborne contamination, such as if a user should sneeze or the like, while in the vicinity of the storage and dispensing assembly.

FIG. 4 illustrates a modified form of the invention. The same numerals have been used to identify the same parts, but they are differentiated from the FIG. 3 showing by the addition of a prime suffix. In the FIG. 4 embodiment, the lower end of the side wall sleeve 14' is deflected outwardly to form a shallow flange as shown at 50. A corresponding shallow groove 52 is formed in the corner juncture between the diaphragm lower portion 28' and the axially extending circumferential flange 30'. Thus, when the diaphragm is placed in position on the tubular housing 14, a positive mechanical engagement takes place between the groove 52 and the flared out or flanged portion 50. This is further enhanced by the frictional engagement between the clamp sleeve 32 and the diaphragm sleeve 30'. In this embodiment, the previously-discussed holes 40 are not necessary or desirable.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An apparatus for storing a supply of containers having an upper end and a generally conical side wall tapering to a smaller bottom end, said apparatus comprising a housing having an elongated tubular side wall for maintaining the containers in a stacked, telescopically interfitted relationship, said housing having an open lower end defined by a bottom edge of the tubular side wall with a resilient diaphragm extending across the open lower end with a lower face of the diaphragm having a hole therein to allow the lowermost container to be withdrawn while retaining the stack in the housing, the diaphragm having a circumferentially continuous peripheral flange which extends axially of the housing about the open lower end in close engagement with the exterior of the tubular side wall, a clamp ring having a circumferentially continuous clamp sleeve portion interference fitted over the peripheral flange of the diaphragm to clamp the flange to the side wall, said clamp ring further including a radially inward directed collar flange joined to the sleeve portion at the lower end thereof and extended continuously about the diaphragm in close engagement with the lower face thereof to locate the clamp ring on the housing and prevent the diaphragm from being deflected away from the bottom edge of the tubular side wall.

2. The apparatus as defined in claim 1 wherein the clamp ring further includes a downwardly extending protective sleeve portion joined to the collar flange for limiting user contact with the lower face of the diaphragm.

3. The apparatus as defined in claim 2 wherein the protective sleeve portion includes a first portion integral with the clamp ring and a second portion removably joined to the first portion.

4. The apparatus as defined in claim 2 wherein the second portion of the protective sleeve is joined to the first portion by a resilient snap connection.

5. The apparatus as defined in claim 1 including radially inward open portions formed about the lower end of the tubular wall of the housing at a location under the peripheral flange of the diaphragm to allow portions of the peripheral flange to extrude thereinto.

6. The apparatus as defined in claim 1 wherein the collar flange extends radially inward a distance at least slightly greater than the thickness of the tubular side wall.

7. The apparatus as defined in claim 1 wherein the bottom edge of the tubular side wall is deflected radially outward and is received in a shallow groove formed about the interior of the clamp sleeve portion closely adjacent the collar flange.

8. The apparatus as defined in claim 1 wherein side collar flange is integral with the clamp sleeve portion of the clamp ring and extends perpendicular thereto.

* * * * *